United States Patent [19]

Kelly et al.

[11] 4,063,696

[45] Dec. 20, 1977

[54] SLOTTED TAKE-UP PACKAGE TUBE FOR OPEN-END SPINNING MACHINES

[75] Inventors: Vincent S. Kelly, Greensboro; Murry W. Munns, Jr., Smithfield, both of N.C.

[73] Assignee: Burlington Industries, Inc., Greensboro, N.C.

[21] Appl. No.: 716,799

[22] Filed: Aug. 23, 1976

[51] Int. Cl.[2] ..... B65H 75/28

[52] U.S. Cl. ..... 242/125.1; 242/18 PW

[58] Field of Search ..... 242/18 PW, 18 EW, 18 A, 242/18 R, 125.1, 125.2; 57/34 TT

[56] References Cited

U.S. PATENT DOCUMENTS

| | | | |
|---|---|---|---|
| 3,941,322 | 3/1976 | Hewitt | 242/18 R |
| 3,952,959 | 4/1976 | Shaw et al. | 242/18 PW |

*Primary Examiner*—George F. Mautz

*Attorney, Agent, or Firm*—Cushman, Darby & Cushman

[57] ABSTRACT

A yarn package take-up tube having a pair of non-parallel slots extending inwardly from the periphery of the tube along the length thereof in a converging fashion. The pair of slots form a passageway through the walls of the tube so that yarn running therethrough will tend to flow in a substantially straight line interiorly of the tube and between the pair of slots. In practicing the process, the slotted opening within the take-up package allows running yarn to be engaged within the passageway formed by the slots with a single scooping motion without severing the yarn so that the running yarn can continue to pass through the slots as the take-up tube is placed in the yarn collections on specification.

11 Claims, 6 Drawing Figures

SLOTTED TAKE-UP PACKAGE TUBE FOR OPEN-END SPINNING MACHINES

The preferred embodiment of the present invention disclosed herein relates to yarn processing methods and apparatus employed when replacing a fully wound yarn package with an empty take-up tube and for assuring the forming of a yarn reserve or tail on that empty take-up tube as winding is initiated. In particular, the present invention relates to an improved yarn package take-up tube that more readily allows running yarn to be engaged, assures proper tail formation, provides a convenient means for checking whether a tail is formed and for retrieving that tail at later processing stages.

In many types of textile processing equipment in which yarn packages are being formed, it becomes essential at some point in the processing to replace a fully formed package with an empty bobbin or take-up tube. In certain types of yarn processing machines, such as open end spinning machines, it is desirable to be able to replace full packages with empty take-up tubes with as little interruption in the processing as is possible and also without severing the yarn running between the open end spinning element and a vacuum take-up or aspirator.

In open end spinning processes, when a completed yarn package is to be replaced, an operator will sever the yarn going to the completed package and divert its flow to a vacuum take-up device or aspirator so that yarn continues to flow from the open end spinning rotor. The problem thereafter faced by the operator is to divert the running yarn from the aspirator to an empty take-up tube so that winding of another package can be commenced without breaking the yarn.

In all instances, however, it is desirable in fact necessary to form a yarn tail or a reserve winding of yarn on one end of the empty take-up tube simultaneously with the initial rotation of the empty take-up tube so that the end of yarn on one package can be connected to the beginning end of yarn on another package. Further, it is essential that this yarn tail not be positioned beneath yarn forming the package. Rather to be useful the tail must be positioned outside the axial extent of the completed package for this reserve amount of yarn is utilized in subsequent processing.

At the present time there are two known methods for transferring running yarn onto an empty take-up package. One employs a transfer tail gun which is comprised of a stationary cutting blade, a wire guide or hook for securing yarn flow, a metal disc mounted directly adjacent the hook, and a movable cutting blade positioned so that when operated with the stationary cutting blade the yarn is hopefully severed.

The function of the transfer tail guide is to retrieve the thread line running from the spinning unit into the aspirator and to transport the yarn while running up to the level of take-up package already in place. With the running yarn at the level of the empty take-up package the transfer tail gun is used to insert the yarn flow between the take-up package tube and one of the end flanges on the take-up arbor which supports the yarn package take-up in its proper position. As the yarn is inserted between the tube and the end flange, the metal disc is pushed between the tube and the flange thus separating them to allow the yarn to be inserted therebetween. At the same time a trigger on the transfer tail gun contacts the take-up tube and actuates the movable cutting blade so that the yarn can be cut between the take-up package and the aspirator all this being done simultaneously with starting the rotation of the empty take-up tube. If done correctly, yarn will wind around one end of the take-up package tube for several turns before being engaged by a traversing yarn guide on the winding unit employed to cause the yarn to traverse back and forth and form a uniform yarn package of proper width.

In order to properly use a transfer tail gun it is necessary that at least the spinning unit adjacent the transfer insertion end of the take-up tube in the unit that is to be put back into production must be turned off and taken out of production to allow sufficient room to maneuver the gun.

The second known approach employs a modified take-up tube and two such tubes are disclosed in German Pat. No. 2,404,387. One of these modified tubes is also described in U.S. Pat. Nos. 3,941,322 and 3,952,959. One tube described in the German patent and U.S. Pat. No. 3,941,322 is modified from a solid tube by being provided with cavities diametrically opposed in opposite ends of the tube which are cut perpendicular to the centerline of the tube and parallel therewith. The method disclosed for using that modified tube requires the empty take-up package be placed over the vacuum source or aspirator at some time prior to the beginning of the doff cycle. When the yarn package being wound is completed, yarn flow is diverted so as to pass from the spinning unit to the vacuum source or aspirator but through the interior of the empty tube placed thereover. As indicated, the empty tube is provided with diametrically opposed grooves at opposite ends of the tube. After the full completed package has been removed, the empty bobbin is slid along the running yarn with the yarn running through the interior of the tube and the empty tube is then placed within the support members such as end flanges on the take-up arbor which hold the empty tube in its take-up position. As indicated, the yarn continues to run from the spinning unit to the aspirator or collection device through the empty tube and within the cavity at each end. When the empty tube is in its proper take-up position, rotation of the tube is initiated. Yarn running within the tube is severed from the vacuum take-up device with yarn that is hopefully remaining within the tube acting as the reserve length of yarn or the transfer tail. Many of the open end spinning machines do not provide the capability of having an empty yarn tube placed in a fixed relationship with the aspirator or vacuum take-up device so that the tube can be retained in position over that vacuum take-up device. Thus the ability to have the yarn pass from the spinning unit to that vacuum take-up device through the interior of the take-up tube is not possible to achieve except on particular types of apparatus.

Another modified take-up tube is shown in the above-identified German patent and U.S. Pat. No. 3,952,959. The tube in this instance is provided with two parallel slots on the same end, which are provided with round openings or apertures at the inward ends thereof which have a diameter larger than the width of the slot. As was the case previously in other processes when the full wound package has been removed yarn flow is diverted from the spinning unit to a vacuum take-up device or aspirator. In order to engage the running yarn within the two parallel slots the tube must be manipulated through a two-step process so that yarn is first caught in one slot with the tube then being rotated so that the yarn can then be engaged in the other slot. The tube is then further manipulated so that the yarn is moved into and running through the two rounded openings at the inner end of the slots. With the yarn running through the two rounded openings, the empty tube is creeled as with the other tubes between support end flanges on a take-up arbor and when rotation of that empty tube is initiated, a length of yarn will hopefully be wrapped around the tube so as to form a transfer tail.

The use of transfer tail guns are not satisfactory since operators experience great difficulty in correctly placing the yarn between the end of the tube and the end flange on the support arbor. In addition, when the movable cutting blade is actuated, the cutting mechanism frequently fails to cut the yarn at the proper point or at all so that additional lengths of yarn remain adjacent the end of the tube. When this occurs, yarn flow will sometimes be diverted to the axle supporting the end cap on the arbor where it will become wrapped or an overly long tail will become wrapped around the axle. In either event, when the completed package is doffed, yarn wound around the axle supporting the end cap lengthens the doffing process. The tail may break next to the yarn wound on the tube and be lost or separately cut. Further, the extra yarn will also have to be cleaned off of the axle by the operator. In addition, if sufficient amount of yarn becomes wound about the support axle, rotation of the package being formed can be affected.

The modified tube which employs parallel slots with holes at the end also suffers from certain disadvantages. First, the process of engaging the yarn within the slots and finally within the holes is a two-step procedure which is more time consuming due to the amount of manipulation involved. Secondly, the fact that the slots and holes at the base thereof are space relatively close together places tension on the running yarn and the necessary manipulation creates additional tension often sufficient to cause the yarn to be severed during the period when the operator is attempting to engage the yarn or when the package is being moved to its creeled position. If the yarn is severed during this point in the creeling process, yarn flow from the spinning unit to the vacuum take-up device will likewise be severed and the operator will have to reestablish flow of yarn from the spinning unit. In addition, applicants have noticed that the portion of the tube between the parallel slots is fragile and subject to being broken during normal handling of empty tubes and that the yarn running therethrough can come out if tension is not properly maintained.

The amount of time required to accomplish the doffing cycle is of course significant costwise to the yarn making process. Any mistakes or extra steps add to the total amount of time required by the operator to accomplish the doffing and thereby decrease output. In addition, yarn breaks require the operator to rethread the machine before the winding operation of the new package can be initiated and any yarn wound on the axle supporting the end caps will have to be removed prior to creeling another empty tube each of which increases the cost of producing the yarn. Thus, to obtain the most efficient operation it is desirable to have the creeling operation simplified so that it could be performed quickly and accurately without yarn breaks or any of the other problems discussed hereinbefore.

SUMMARY OF THE PRESENT INVENTION

The preferred embodiment of the modified tube which is the subject of this application is made so that the engaging of yarn running between the spinning unit and the aspirator can be easily and gently accomplished with one simple motion. Also, the positioning of the slots in the end of the modified tube allow a relatively straight, clear passageway through which yarn can freely travel during the engaging process. Such a straight passageway also allows the yarn to continue running easily through the openings as the empty tube is being creeled.

The slots provided within the tube are angled so that they converge toward one another as they extend inwardly from the end of and along the side of the tube. As yarn flows through the slots under slight tension, the yarn will be retained within the interior portion of the slots as the tube is being creeled onto the take-up portion of the machine and the yarn will not slip out.

In addition, the two slots preferably are aligned so that a plane is formed thereby which is slanted rearwardly toward the central axis of the tube thus providing a better scooped-type passageway with which the operator can easily engage the yarn.

BRIEF DESCRIPTION OF THE DRAWINGS

The improved take-up tube according to the preferred embodiment of the present invention will be better understood from the following description thereof in conjunction with the accompanying drawings of which.

Figure 1:
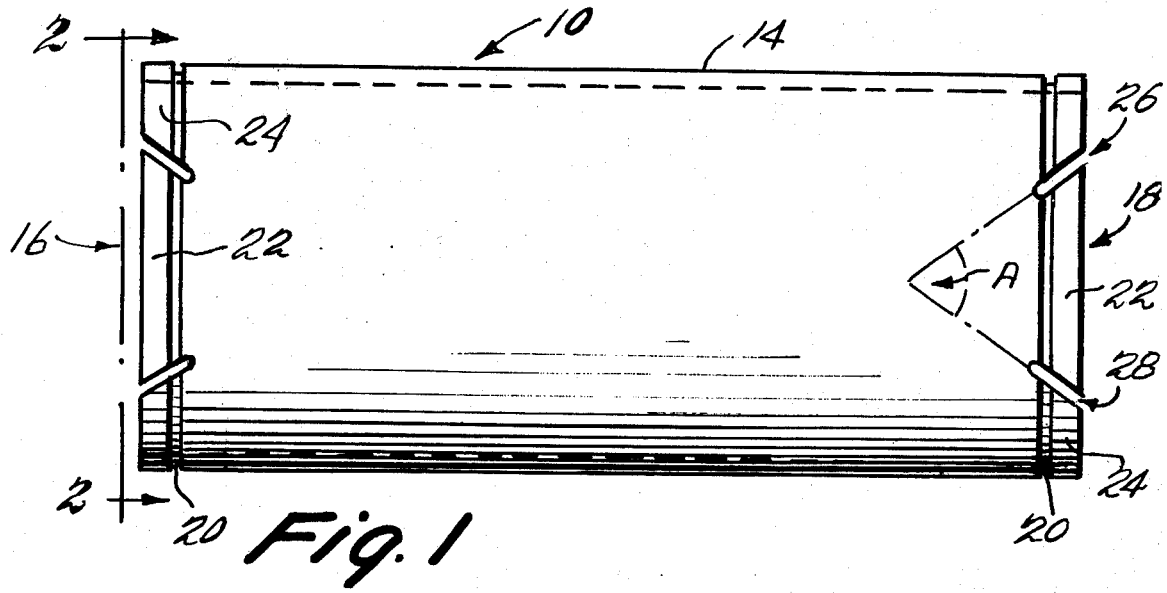
FIG. 1 is an elevational view of the front of the improved take-up tube according to the present invention.

Turning now to the drawings and in particular FIG. 1, the preferred embodiment of the take-up tube as described in this present application is indicated generally at 10. The tube 10 is comprised of a cylindrical casing 12 having long sides 14 and ends 16 and 18. Generally, such take-up tubes are constructed from a plastic material such as a phenolic resin, polyethylene or polypropylene but any suitable hard material can be used such as metal or aluminum or even compressed paper products. It is essential only that the tube be rigid and preferably of a standard size. A circumferential groove 20 is provided adjacent each end of the tube 10 for purposes of holding the transfer tail in alignment with the particular end at which it is being formed and in order to assist in winding the transfer tail around the tube. Applicants have found that this circumferential groove 20 is not essential but does assist in a proper placing of the transfer tail adjacent the end of the package.

As shown in FIG. 1, each end of casing 12 is provided with two shoulder portions 22 and 24. Shoulder portion 22 is smaller in that it extends around a smaller portion of the circumference than does shoulder portion 24 but each extends for a predetermined distance about the circumference of tube 10. The shoulders 22 and 24 are separated circumferentially a predetermined distance and thereby define slots 26 and 28 therebetween. It is essential that slots 26 and 28 be formed on at least one end of tube 10 but as shown in FIG. 1 slots 26 and 28 can be formed in each end. By forming a tube in this latter fashion, it makes no difference which way the tube is oriented when the operator reaches for a tube.

Figure 2:
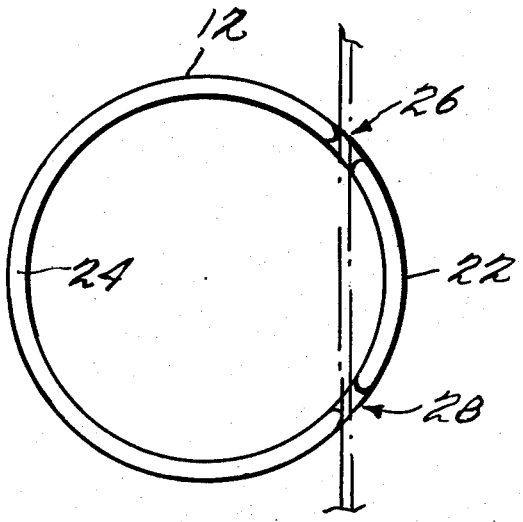
FIG. 2 is a view of one end of the tube shown in FIG. 1 and along line 2—2 of FIG. 1.

As indicated previously, it is desirable that the slots 26 and 28 together produce a yarn passageway through tube 10 that will allow the operator to engage a running yarn in both slots 26 and 28 simultaneously but will also provide a straight-through, clear flowing passageway through which the yarn can pass. Thus, slots 26 and 28 are arranged so that yarn would both enter and exit tube 10 in a relatively straight line prior to moving the tube into its creeled position. This is best shown in FIG. 2 where the yarn Y is shown in phantom.

Slots 26 and 28 are cut and the sidewall 14 of tube 10 such that they extend inwardly from the end thereof toward the center of casing 12. Also, slots 26 and 28 are cut so that they converge towards one another as they extend inwardly toward the center of casing 12 along sidewall 14. By constructing slots 26 and 28 in this fashion a generally triangular shaped wedge is formed between the slots and that shape will tend to retain yarn Y in the lower most portions of those slots. The end of each slot 26 and 28 is shown as extending inwardly a slight distance past circumferential groove 20 so that retension of yarn Y at the innermost portions of slots 26 and 28 will position the yarn directly adjacent groove 20. The extent to which slots 26 and 28 extend inwardly along sidewall 14 of casing can vary and will be determined only by the width of the package to be formed on tube 10 since as indicated previously it is essential that the transfer tail remain outside of the area taken up by the yarn package to be placed on tube 10.

Figure 6:
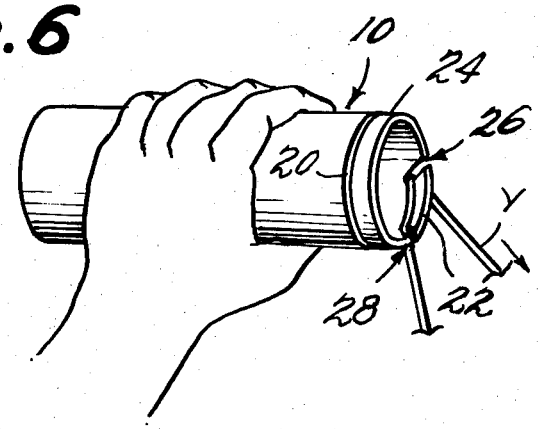

The angle indicated at A or the angle formed by slots 26 and 28 is not critical but preferably ranges between about 40° to about 70° and the preferred angle is about 60°. By forming slots 26 and 28 in this manner, yarn Y will be positively retained therein, as shown in FIG. 6, during that period of the creeling operation when the empty tube is being raised into its supported take-up position into a support arbor (not shown).

Figure 3:
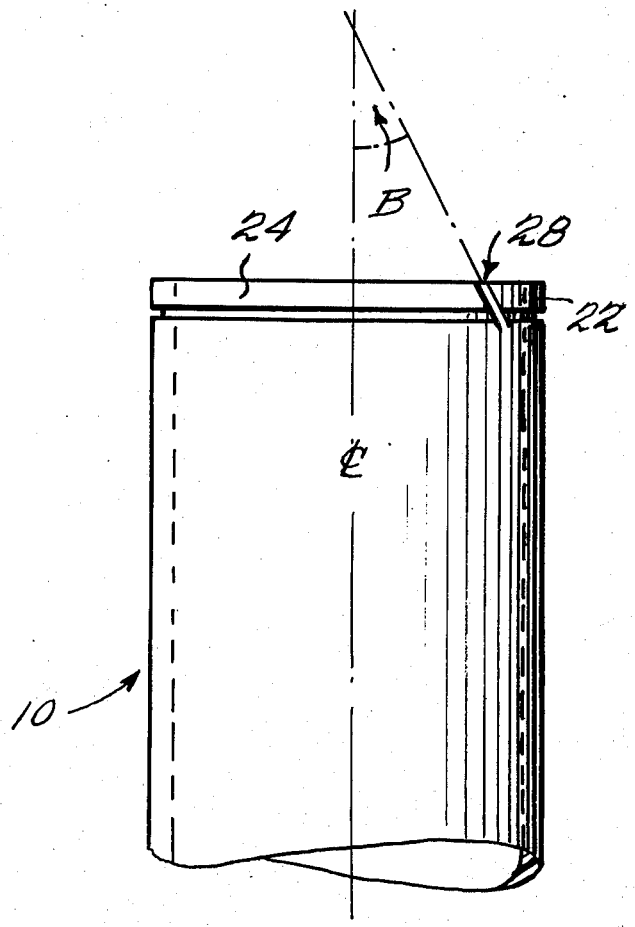
FIG. 3 is a side elevational view along line 3—3 in FIG. 2.
Figure 4:
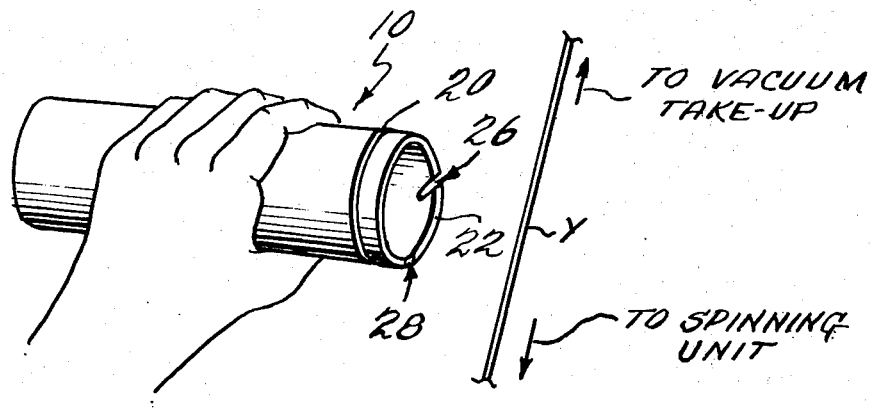
FIGS. 4–6 are front elevational views illustrating the modified tubes shown in FIG. 1 at three subsequent successive stages during creeling of the take-up tube.

As shown in FIG. 3, slots 26 and 28 are aligned to form a clear passageway through tube 10 and thus define the passageway for yarn Y. A plane formed by slots 26 and 28 slopes rearwardly toward the centerline of tube 10 at an angle indicated at B of approximately 30°. However, it should be well understood that the particular angle at which the plane formed by slots 26 and 28 is slanted rearwardly toward the centerline of tube 10 is variable between about 20° to about 40°. By slanting the slots 26 and 28 in this fashion so that the slots 26 and 28 slope rearwardly along their length from the exterior to the interior a scoop is essentially formed from the triangular material comprising the rim 22 which can be used by the operator to easily engage the running yarn Y in a scoop-like motion allowing the running yarn Y to be simultaneously engaged within both slots 26 and 28. No additional manipulation of tube 10 is required to place yarn Y within slots 26 and 28 and since the passageway formed by slots 26 and 28 is straight. Further, with the yarn running at a tangent to the arc formed between slots 26 and 28, the flow of yarn Y through slots 26 and 28 is essentially frictionless until yarn Y occupies a position at the most inward portions of slots 26 and 28 as shown in FIG. 6 of the drawings.

As representative of the dimensions of an improved slotted take-up tube as described herein the following example is provided. The tube itself would be approximately 170 millimeters in length (about 6 ¾ inches) and casing 12 is approximately 4 millimeters thick. The external diameter of the casing 12 is approximately 60 millimeters and the circumference thereof is about 185 millimeters. Shoulder portion 22 extends around the circumference at the end of tube 10 for a distance of about 135 millimeters, slots 26 and 28 are respectively 3 millimeters in width along their length and shoulder member 24 extends around the circumference of the end of tube 10 for about 44 millimeters. The distance between the base of slots 26 and 28 around the outer circumference of casing 12 is approximately 31 millimeters and groove 20 is located approximately 10 millimeters inwardly from the ends 16 and 18 of casing 12.

As will be noted from FIG. 2, it is important that the edges on each side of slots 26 and 28 be curved or rounded so that there are no sharp edges on which portions of the fibers within yarn Y might snag. The curving of these edges can be obtained by polishing or grinding and in some instances it might be desirable to provide a coating of wax which will ease the passage of yarn through each of the grooves.

The groove 20 in which the reserve thread supply can be wound would preferably be 1/16th of an inch wide and 1/32nd of an inch deep.

An additional feature of the take-up tube as modified according to the present invention is the fact that a piece of yarn will remain extending between slots 26 and 28 and thus span across the interior of the tube, as is shown in phantom in FIG. 2, after formation of the transfer tail. Thus, a portion of the yarn which comprises the transfer tail will be easily seen by an operator and likewise the predetermined distance between slots 26 and 28 is so designed that the thread line forming the base of the arc formed by slots 26 and 28 is long enough so it can be easily grasped by an operator when the tail is retrieved for connection to another package of yarn. This provides a convenient way for the operator to check whether a tail has been formed when a fully wound package is doffed. It has been found that as long as yarn extends within the tube between slots 26 and 28 a proper tail has been formed. In addition, spacing spaced apart of slots 26 and 28 is such that should a portion of the tail become engaged beneath the wound package, or in the event of a yarn transfer tail failure, a portion of the transfer tail will remain visible and accessible to the operator making salvaging of the yarn tail simpler. This is so since there will be a sufficient length of the transfer tail which can be grasped by the operator which length provides enough leverage for the operator to successfully pull the remaining portion of the tail from under the package, to pull a new tail from beneath the package in the event of a yarn transfer tail failure, or a sufficient length to repair the tail if full retrieval is not possible.

Figure 5:
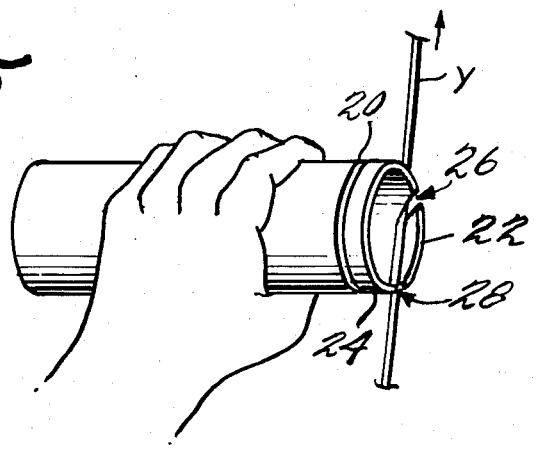

Thus, in operation, when a yarn package has been wound to its proper size the operator will sever the yarn running between the package being wound and the spinning unit and divert the yarn to the vacuum take-up device on the spinning machine. The fully wound package is removed from the machine and an empty yarn package take-up tube, as described herein, is grasped by the operator. In one scoop-like motion as shown in FIG. 5, the operator will place yarn Y within grooves 26 and 28. At this point yarn Y is running between the vacuum take-up device and the spinning unit through the passageway formed by grooves 26 and 28 as shown in FIG.

5. The tube will be raised toward its creeled position which places tension on the yarn and causes the yarn flow to be as is shown in FIG. 6. Once the empty take-up tube is in the conventional creeled position, (not shown), the operator then simultaneously initiates rotation of the empty tube and severs the yarn Y at the point the yarn enters the vacuum take-up device. The free end of yarn severed from the vacuum take-up will be wound on tube 10 adjacent the end thereof and out of the range of the yarn traverse guide, (not shown), and it is this portion becoming the transfer tail. In this manner, the length of the transfer tail can be accurately controlled since the operator can to a certain degree, break the yarn where desired between the take-up tube and the vacuum take-up portion of the device.

Applicants have described a modified take-up tube which simplifies the start-up of an empty take-up tube when the full take-up package has been removed, especially in open end spinning operations. The improved process reduces the time necessary to perform the doffing process for take-up package thus resulting in higher machine efficiency and reduces the amount of yarn waste which can occur when doffing a full take-up package. The spinning machine does not have to be modified and no additional equipment is necessary to effectively initiate the winding of new yarn packages. In addition, a proper amount of a reserve length of yarn is achieved in a simple manner and without the necessity of providing separate mechanisms for displacing the yarn outside the limits of its normal traverse so that the transfer tail will not be positioned on the take-up tube beneath that portion of the tube where the package will be formed.

It will now be clear that there is provided a device and process which accomplish the objectives heretofore set forth. While the invention has been disclosed in its preferred form, it is to be understood that the specific embodiment thereof as described and illustrated herein is not to be considered in a limited sense as there may be other forms or modifications of the invention which should also be construed to come within the scope of the appended claims.

What is claimed is:

1. An improved yarn take-up package tube comprising a hollow cylindrical casing, means for defining a pair of non-parallel slots extending inwardly in a converging fashion from the rim of said tube along the length thereof, said slots being spaced apart a predetermined distance about the circumference of said tube, said slots being of a sufficient width so as to define a relatively straight passageway through said hollow cylindrical casing.

2. An improved yarn take-up tube comprising a hollow cylindrical casing having first and second shoulder members extending outwardly from at least one end of said tube, each of said first and second shoulder members extending around a predetermined portion of the circumference of the end of said tube and being spaced apart so as to define two elongated slots therebetween, wherein said slots are angled so as to converge toward one another as they extend inwardly from the end of said tube along the length thereof, said slots being spaced apart about the circumference of said tube, said slots being of a sufficient width so as to define a relatively straight passageway through said first and second shoulder members.

3. An improved yarn take-up tube as in claim 2 wherein said tube is provided with a circumferential groove positioned inwardly from the end of said tube a predetermined distance so as to intersect said slots.

4. An improved yarn take-up tube as in claim 3 wherein said slots extend inwardly a slight distance beyond said circumferential groove.

5. An improved yarn take-up tube as in claim 2 wherein said first and second shoulder members extend outwardly from each end of said tube so as to define pairs of converging slots at each end thereof.

6. An improved yarn take-up tube as in claim 2 wherein said slots converge toward each other at a predetermined angle, said angle ranging between about 40 to about 70 degrees.

7. An improved yarn take-up tube as in claim 6 wherein said angle at which said slots converge is preferably about 60 degrees.

8. An improved yarn take-up tube as in claim 2 wherein said slots are aligned so that together they define a plane corresponding to the yarn passageway through said tube, said plane being sloped rearwardly toward the center of said tube.

9. An improved yarn take-up tube as in claim 8 wherein the rearward slope of the plane defined by said slots is preferably at an angle with the centerline of said tube ranging between about 20° to about 40°.

10. An improved yarn take-up tube as in claim 9 wherein the preferred angle of rearward slope of the plane defined by said slots with respect to the centerline of said tube is 30 degrees.

11. A method of replacing a fully wound yarn package by an empty take-up tube in an open end spinning machine including the steps of simultaneously severing yarn flowing from the spinning unit to the fully wound package and diverting the yarn to a collection device, simultaneously inserting the yarn running between the spinning unit and the collection device within a pair of converging slots provided on one end of the empty take-up tube, removing the fully wound take-up package and creeling the empty take-up tube so that yarn continues to move between the spinning unit and the collection device through the passageway formed by the pair of converging slots and thereafter simultaneously initiating rotation of the empty take-up tube and severing the running yarn adjacent the collection device so that the initial rotations of the empty take-up tube will wrap the yarn extending between the slots and collection device around the tube adjacent the end of the tube provided with the pair of converging slots.

* * * * *